United States Patent [19]

Wilkie

[11] Patent Number: 4,762,586

[45] Date of Patent: Aug. 9, 1988

[54] COMBINATION TAPE APPLICATOR AND TAPE DISPENSER

[76] Inventor: Robert C. Wilkie, 513 N. Electric, Apt. C, Alhambra, Calif. 91801

[21] Appl. No.: 74,077

[22] Filed: Jul. 16, 1987

[51] Int. Cl.[4] ..... B26F 3/02; B32B 35/00

[52] U.S. Cl. ..... 156/527; 156/576; 156/577; 156/579; 225/20; 225/39; 225/77

[58] Field of Search ..... 156/523, 527, 530, 574, 156/575, 576, 577, 579; 225/20, 30, 77

[56] References Cited

U.S. PATENT DOCUMENTS

| | | | |
|---|---|---|---|
| 2,486,470 | 11/1949 | Fritzinger | 156/527 |
| 2,582,979 | 1/1952 | Fritzinger | 156/523 |
| 2,606,682 | 8/1952 | Cutter | 156/523 |
| 3,523,053 | 8/1970 | Zbinden et al. | 156/523 |
| 3,586,587 | 6/1971 | Boyce | 156/527 |
| 3,707,426 | 12/1972 | Robison | 156/527 |
| 3,725,182 | 4/1973 | Regan | 156/527 |
| 3,745,086 | 7/1973 | Parker | 156/527 |
| 3,785,901 | 1/1974 | Fritzinger | 156/527 |
| 3,813,275 | 5/1974 | Weick et al. | 156/527 |
| 4,097,328 | 6/1978 | Urushizaki | 156/523 |
| 4,238,271 | 12/1980 | Urushizaki | 156/523 |
| 4,253,905 | 3/1981 | Regan | 156/523 |
| 4,345,966 | 8/1982 | Iiyama et al. | 156/523 |

*Primary Examiner*—Michael Wityshyn

*Attorney, Agent, or Firm*—Christie, Parker & Hale

[57] ABSTRACT

Disclosed is a combined tape dispenser and hand-held tape applicator formed of a minimum of molded components designed for interlocking assembly without fasteners. The housing includes a handgrip lockable either in an extended position when employed to apply tape to a surface or in a retracted position when not in use or when used to dispense tape from a desk top support. The tape is mounted on a tape carrier normally biased to an extended tape-applicating position and manually retractable to expose a normally guarded cutting blade for severing the tape. While the carrier is moving between retracted and extended positions, a tape catcher clutches the tape reawardly from its free end and holds it captive with the free end thereof extending outwardly beyond the dispensing port in visible readiness for precise visible attachment to a surface to be taped. The tape carrier is movable toward its retracted position either by a trigger adjacent the handgrip or by pivotal movement of the handgrip substantially to its retracted position. A blade guard is normally held in a position to shield the cutter from the tape when the carrier is in its extended position. When the carrier moves to its retracted position, the blade guard is suddenly released to rotate freely from its shielding position to an unblocking position allowing the tape to be suddenly forced against the fixed blade for rapidly cutting the tape.

36 Claims, 2 Drawing Sheets

FIG. 5
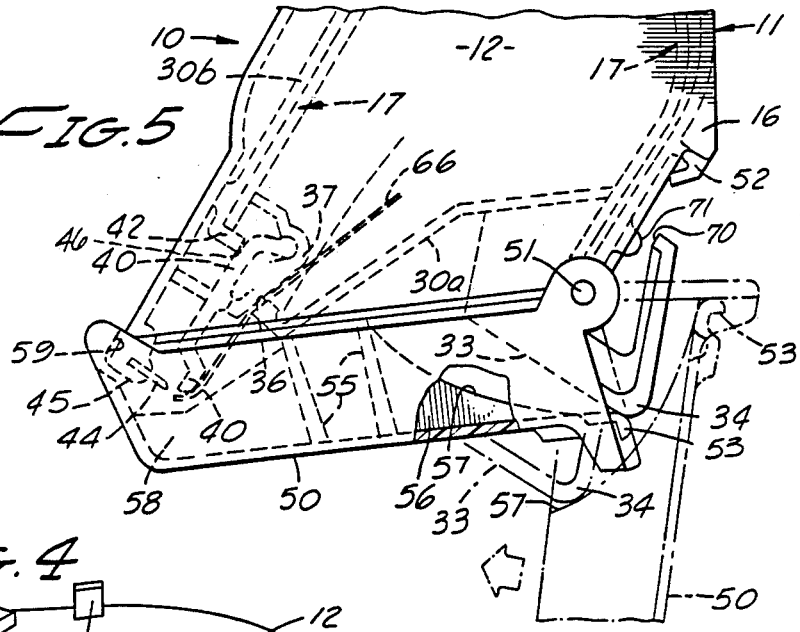
FIG. 4
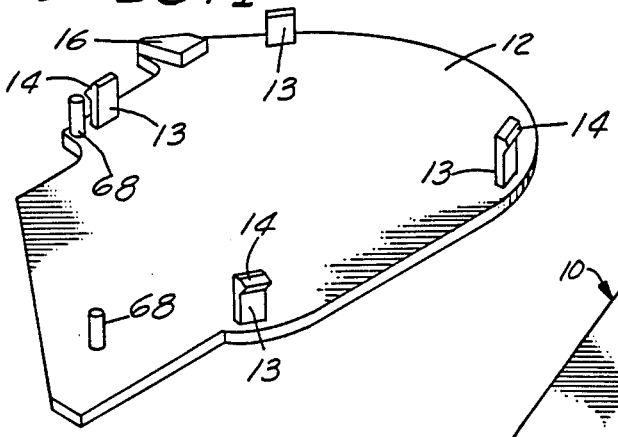
FIG. 6
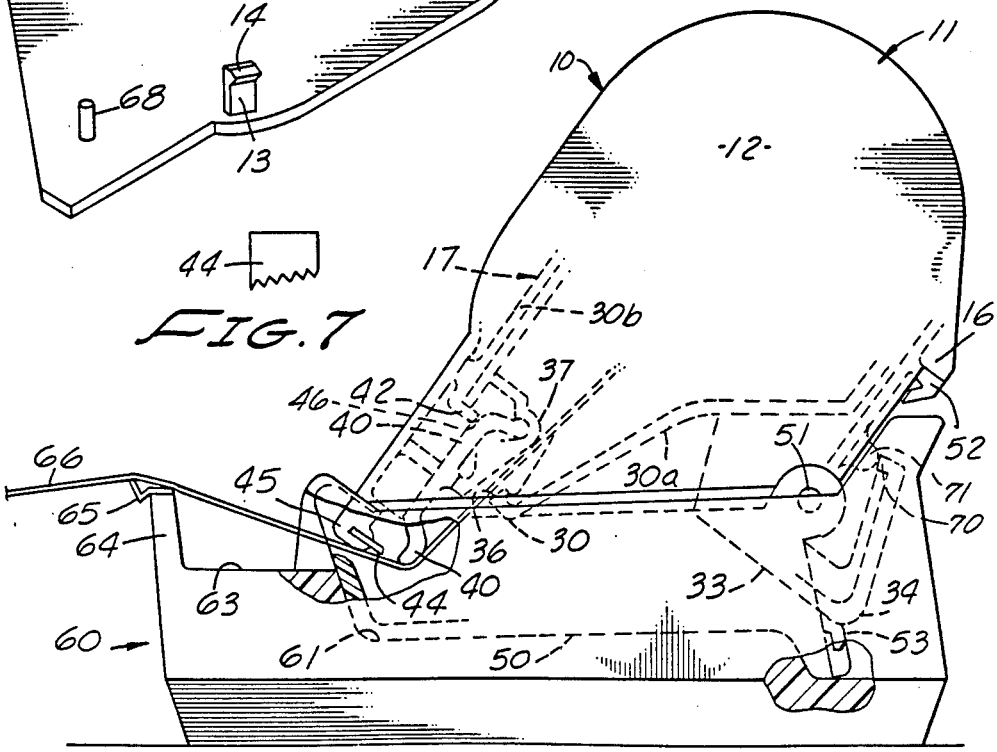
FIG. 7

COMBINATION TAPE APPLICATOR AND TAPE DISPENSER

FIELD OF THE INVENTION

This invention relates to portable tape applicators, and more particularly to a lightweight pressure sensitive tape holder selectively usable either to apply a selected length of tape directly to a surface or as a desk mounted tape dispenser.

BACKGROUND OF THE INVENTION

The wide scale use of pressure sensitive masking tape and scotch type tapes has inspired a proliferation of devices for dispensing and/or applying these tapes. Prior constructions provided to meet these needs are subject to numerous shortcomings and disadvantages including complexity, costly construction, complex means for severing the tape at the end of an application cycle, unsatisfactory means for retaining the tape captive between dispensing cycles and for presenting a sufficiently long free end in a viewable and accessible position for accurate anchoring to a surface without displacement or damage to that surface at the start of and during a dispensing cycle, lack of means for storing the free end of the tape in a protected position concealed within the housing when the device is not in use and other shortcomings. Fritzinger U.S. Pat. No. 2,582,979, Zbinden U.S. Pat. No. 3,523,053, Urushiazaki U.S. Pat. No. 4,097,328 and U.S. Pat. No. 4,238,271 and Iiama U.S. Pat. No. 4,345,966 patents each propose tape applicators having retractable tape carriers but each requires linkage means to move a cutting knife into a severing position upon retraction of the tape carrier. Fritzinger U.S. Pat. No. 2,486,470, Cutter U.S. Pat. No. 2,606,682, Regan U.S. Pat. No. 3,725,182 and U.S. Pat. No. 4,253,905 and Weick U.S. Pat No. 3,813,275 patents each propose a tape applicator having a handgrip portion, but in no instance is the handgrip foldable, operatively connected with a retractable carrier, or useful in protecting the free tape end when the applicator is not in use. Boyce U.S. Pat No. 3,586,587, Regan U.S. Pat No. 3,725,182, Parker 3,745,086 and Fritzinger 2,486,470 and U.S. Pat. No. 3,785,901 patents show applicators having severing blades with protective expedients during a dispensing cycle, but in no instance is the guard mechanism operatively associated with a retractable tape carrier. Robison U.S. Pat. No. 3,707,426 proposes a hand held tape applicator having two tape dispensing ports, one of which is useful in applying tape to a long flat surface and the other of which is useful when it is desired to detach short lengths of tape for hand application. In either mode of use the device must be hand held.

SUMMARY OF THE INVENTION

To avoid the shortcomings and disadvantages of these and other prior tape applicators or dispenser, the present invention provides a combined compact, lightweight device selectively usable as a tape applicator or as a hand held tape dispenser mountable in a supporting base on a desk top. The tape holder carrier proper is reciprocally supported in a main housing and is normally biased toward its extended position to display a preselected length of tape in a viewable and accessible position for accurate application to a surface as the applicator is pulled rearwardly. At the end of the tape applicating step the operator manually presses a trigger to retract the tape carrier, thereby suddenly unlocking a guard member for a cutter blade and simultaneously capturing the tape on a carrier-mounted tape catcher well before the cutter blade and a new free tape end that is about to be created. While the carrier is held retracted, continued rearward movement of the applicator now serves to sever the tape by its contact with the blade, leaving a free end of tape extending beyond the tape catcher to the cutter blade. The tape carrier trigger is then released and the carrier is extended slightly until trigger latches are frictionally engaged. This slight extension of the carrier initiates relocking of the cutter guard in its guard position, moving the free tape end (which is now held substantially within the applicator and thus out of contact with any underlying surface) away from the cutter blade. Upon release of the trigger latches the carrier is free to move to a fully extended position, presenting the free end of the tape in an exposed position for the next applicating cycle.

The applicator has a handgrip selectively lockable in its extended position and in a retracted position. The movement of the handgrip to its retracted position automatically retracts the tape carrier and withdraws the free end of the tape to a concealed protected position. The end of the handgrip includes a tape dispensing port for use when the dispenser is clipped or frictionally held seated in a weighted base for use as a desk mounted dispenser. This base includes its own combined tape catcher and severing blade for use in cutting the tape and in supporting the tape end between dispensing cycles.

In one embodiment, the complete applicator, excluding the weighted base, is formed of seven components, five of which are molded plastic and all of which are arranged for interlocking assembly without the need for fasteners or adhesives. The only nonplastic parts are a torsion spring and a cutting blade.

Accordingly, one object of this invention is to provide an improved hand held compact tape applicator formed of a minimum of components held assembled without fasteners.

Another object of the invention is to provide a tape applicator operable without surface pressure and having a handgrip equipped with a finger operated trigger for retracting a tape carrier normally biased to an extended position and having a tape catcher presenting the free end of the tape exposed and visible for accurate registry with a surface to be taped.

Another object of the invention is to provide a tape applicator having a fixed cut off blade normally guarded from contact with the tape but operatively connected to a manually operable control to unlock the guard in readiness for severance of the dispensed tape.

Another object of the invention is to provide a tape applicator having a retractable tape carrier with a cutter blade guard normally locked in guard position but releasable to an unlocked condition when the tape carrier is manually retracted to a predetermined position.

Another object of the invention is to provide of a hand-held tape applicator having a short length of tape exposed and freely visible and accessible for accurate placement on a surface to be taped, and wherein the applicator can be manipulated to dispense a selected length of tape out of contact with the surface before being lowered into contact therewith whereby the deposited tape remains untensioned.

Another object of the invention is to provide a tape applicator operable to dispense and cut off a selected length of tape against a surface in a smoothly executed simple movement free of twisting or altered direction of movement.

Another object of the invention is to provide a tape applicator having a retractable tape carrier normally biased to an extended tape dispensing position and selectively manually movable to a retracted position with the free end of the tape held selectively and protectively retracted between operating cycles.

Another object of the invention is to provide a combination hand-held tape applicator and a desk-mounted tape dispenser.

DESCRIPTION OF THE DRAWINGS

These and other more specific objects will appear upon reading the following specification and claims and upon considering in connection therewith the attached drawings to which they relate.

Referring now to the drawings in which a preferred embodiment of the invention is illustrated:

FIG. 4 is a perspective view of the housing cover as viewed from its interior side;

FIG. 5 is a fragmentary view showing the handgrip unlatched and pivoted partially and fully toward the closed storage position thereof;

FIG. 6 is a side view of the applicator showing the handgrip latched in closed position and the applicator frictionally seated in the well of a weighted base and in readiness for use as a desk-mounted tape dispenser; and FIG. 7 is a side view of the applicator tape cutter having sharp edged serrations lying in an inclined plane across the length thereof.

DETAILED DESCRIPTION

Figure 1:
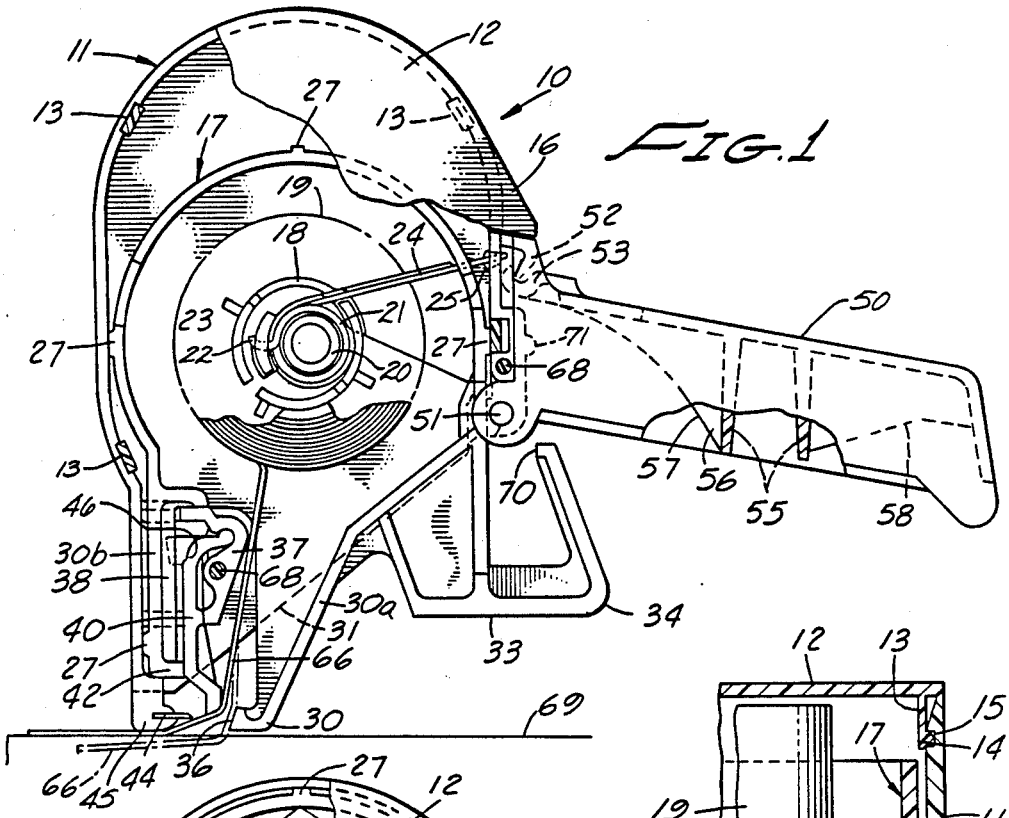
FIG. 1 is a side elevational view of an illustrative embodiment of the invention tape applicator with portions of the cover and handgrip broken away to show constructional details and with the applicator in use to apply a strip of tape to an underlying horizontal surface.
Figure 3:
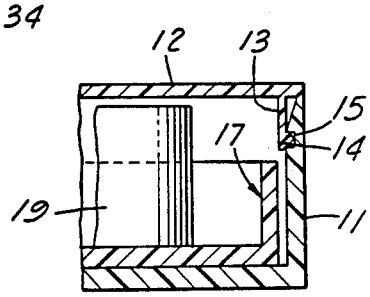
FIG. 3 is a fragmentary cross sectional view on an enlarged scale taken along line 3—3 on FIG. 2 to show one of the cover locking tangs for holding the cover closed.

Referring to FIG. 1, there is shown an illustrative embodiment of a combined tape applicator and tape dispenser, designated generally 10, formed almost entirely from molded plastic components designed to be held assembled without fasteners. The main housing 11 is of modified elliptical cup-shaped configuration normally closed by a detachable cover 12 held in assembled position by integral resilient detents 13. These are best shown in FIGS. 3 and 4 as having protuberances 14 seating in shallow wells 15 on the interior sidewall of housing 11. Cover 12 has a finger grip 16 (FIGS. 1 and 4) protruding therefrom to facilitate removal of the cover.

Slidably supported lengthwise of the interior of housing 11 is a tape carrier 17 having a hub 18 upstanding from the central portion thereof for rotatably retaining a roll of pressure sensitive tape 19. Interiorly of hub 18 is a low height tubular boss 20 embraced by the coil of a spring 21 having one end 22 engaged with a boss 23 integral with the bottom of the tape carrier 17. The other end 24 of spring 21 extends through an opening slot in the sidewall of the carrier 17 into a pocket formed in the sidewall of the applicator housing 11.

Figure 2:
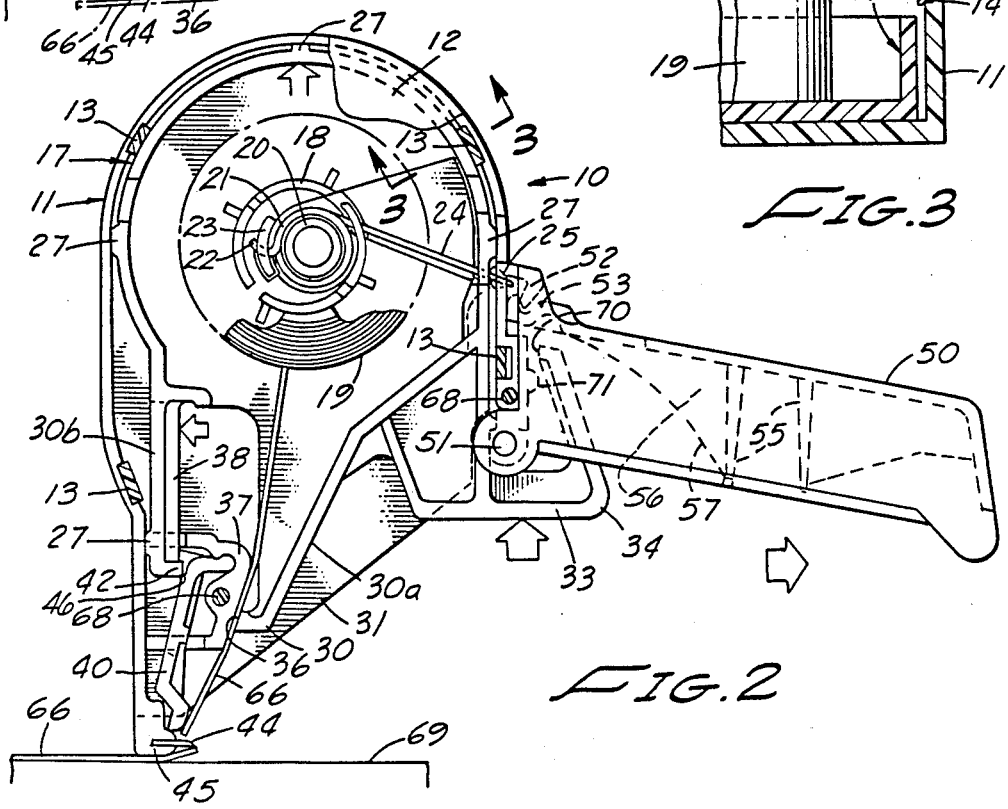
FIG. 2 is a view similar to FIG. 1 but showing the tape carrier trigger held retracted to unlock the cutter guard and enable the tape to be severed.

Spring 21 operates to bias the tape carrier 17 to the extended position thereof shown in FIG. 1 with its semicircular innermost end spaced downwardly from the semicircular upper end wall of housing 11 by a substantial amount. However, when the carrier 17 is forcibly and manually retracted in opposition to spring 21, its semicircular innermost wall is moved upwardly to a retracted position closely spaced from the similarly shaped upper end wall of the applicator housing 11 as shown in FIG. 2. Preferably, the exterior of carrier 17 has a plurality of low height projections 27 along its exterior sidewall serving as stops and cooperating with the adjacent interior sidewalls of the applicator housing to restrict the carrier to generally linear movement lengthwise of the interior of housing 11. Thus, the carrier is free to slide lengthwise of the main housing but is restrained from any substantial twisting or rotary movement.

The upper end of carrier 17 is of low height cup-shape and its lower end 30 is bifurcated and formed with rear and front legs **30*a* and 30*b* respectively which reciprocate through the generally open lower end 31 of housing 11. Projecting downwardly from the lower end wall of carrier 17 is a manually operable trigger 33 having a rounded lower rear corner 34 for a purpose to be described presently. The foremost lower end of leg 30*a* has a flat surface 36 facing forwardly and slightly upwardly toward the adhesive underside of the advance end 66 of the tape on coil 19. Accordingly, surface 36 of the carrier is conveniently designated a "tape catcher" to hold the end of the tape captive between dispensing operations. Carrier legs 30*a* and 30*b* straddle a sideways V-shaped tape guide 37 integral with and extending crosswise of the lower front end of housing 11 inwardly of its open lower end 31. As shown in FIGS. 1 and 2, one leg of tape guide 37 extends downwardly and the other leg extends forwardly with its end bearing against a rib 38 projecting rearwardly from the rearward side of front carrier leg 30*b*, which is thereby guided accurately as carrier 17 is moved between the extended position of FIG. 1 and the retracted position of FIG. 2. Socketed in the interior apex of the sideways V-shaped tape guide 37 is the rounded end of a cutter blade guard member 40. In the position of the parts shown in FIG. 1, blade guard 40 is shown locked in its blade guarding position by the rearward face of the lower rear end 42 of the front carrier leg 30*b*. It is noted that cutter guard 40 is held in its locked guard position against the lower forward end of the downwardly extending leg of sideways V-shaped tape guide member 37. In the blade guarding position, the tape contacts the end surface of the guard member 40** and is thereby held away from contact with the blade.

A stationary tape cutter blade 44, best shown in FIG. 7, is held captively assembled in a tape presser pad 45 extending crosswise of the foremost lower corner of the applicator housing 11. The cutting edge preferably comprises sharp-edged serrations lying in a plane inclined acutely to a plane normal to the axis of the cutter. Accordingly, the leading serration is effective to nick the edge of the tape and initiate expedited severance of the tape. When the cutter guard 40 is locked in its extended position shown in FIG. 1, it is clear that it is impossible for the dispensed end of the tape to come into contact with the cutter blade 44. However, as carrier 17 is retracted to its fully retracted position shown in FIG. 2, the lower rear corner of the lower end 42 of front carrier leg 30*b* moves to a position past the upper end 46 of the front surface of the cutter guard 40, thereby leaving the blade guard 40 suddenly free to pivot about its fulcrum on tape guide 37. The blade guard suddenly pivots toward the blade and unblocks the tape and thereby allows the tape to move toward the blade. The blade guard 40 is thus unrestrained and freely pivots in response to pressure applied to it by the tape as the tape is drawn across the preferably serrated edge of cutter blade 44 to sever the tape in a sudden slicing manner. At the same time, the adhesive side of the tape is contacted by the tape catcher surface 36 to hold the tape in a fixed position after a lower portion thereof has been cut off by the blade. It is important that the cutter blade be positioned such that, when exposed as shown in FIG. 2, the cutting edge is still protected from contacting the surface being taped, but is as close as possible to that surface to allow accurate positioning of the cut end of the tape on that surface. In the present embodiment of the invention, the cutter blade is very close to the surface 69 being taped but lies above and forward of an imaginary straight line between the presser foot 45 and the outer lower end of the handle 50. When the invention is handheld in the position of FIG. 2, with the presser foot 45 on a surface 69 and then rotated clockwise, the lower outer end of the handle 50 (or the operator's hand) will contact the surface and stop further rotation before the cutting edge of cutter blade 44 contacts the surface 69 being taped. It is also important that the angle between the plane of the cutter blade and the plane of the tape at the point where the tape is cut be an acute angle, generally as small an angle as practical. A desired range is an angle of about 10 degrees to about 20 degrees. This ensures a rapid cutting of the tape without tearing of the tape.

The applicator is provided with a folding handgrip 50 pivotally connected to the main housing on trunnions 51 integral with and projecting from the opposite sides of the main housing. The handgrip is rigidly latchable in its normal open position by a pair of latching hooks 52 and 53. Hook 52 is integral with the sidewall of housing 11 and hook 53 is integral with the upper sidewall of the handgrip 50, as best seen in FIGS. 1 and 2. Preferably, the opposite lateral edges of hook 53 are separated from the handgrip wall for a short distance by narrow slots, thereby imparting flexibility to hook 53.

The interior of the handgrip is provided with reinforcing webs 55 including the longitudinal web 56, the arcuate edge 57 of which acts as a camming surface engageable with the rounded nose 34 of trigger 33. Thus, as best shown in FIG. 5, the clockwise pivoting of handgrip 50 about trunnions 51 enables the camming surface 57 within the handgrip to contact the nose 34 of trigger 33 thereby and is effective to cam the attached tape carrier 17 inwardly. By the time the handgrip has been pivoted substantially to the 9 o'clock position shown in FIG. 6, carrier 17 has been retracted to the position slightly short of its fully retracted position, wherein the surface of handgrip hook 53 (FIG. 5) at the base of the handgrip is captively seated against the lower face of trigger 33. The outer end of the handgrip then embraces presser pad 45. This latches the handgrip in its closed retracted position with the nose 34 of the trigger resting against the inner side of the latching hook 53. It will be noted that this hook is mounted cantilever fashion on a long stem formed of the resilient plastic material of the handgrip. The resiliency of this stem is adequate to aid in latching the handgrip in its retracted position but is insufficient to hold the tape carrier fully retracted. Since the tape carrier is not fully retracted, the rearward face of the lower rear end 42 of the carrier leg 30*b* rests against cutter guard member 40 slightly below its upper front end 46, thereby firmly retaining this guard against clockwise pivotal movement and holding it firmly in its guard position as shown in FIG. 5. It will be noted that the outermost interior web 55 contacts the rear carrier leg 30*a* when the handgrip is folded, as shown in FIG. 5, to complete the enclosure of the interior of the applicator 10. The edges of the longitudinal webs 58 prevent the adhesive side of the tape from firmly gripping the interior of the handgrip.

Referring to FIG. 6, applicator 10 is illustrated with its handgrip 50 in its folded retracted position just described and snugly seated in an upwardly opening well 61 of a heavy base 60, thereby converting the applicator into a desk supported tape dispenser. The upper forward end of base 60 is provided with a transverse opening 63 crosswise of the base and rearwardly of a pedestal 64 supporting a combined tape cut off blade 65 and catcher or support for the free end of the tape 66. Preferably, blade 65 is serrated and performs similarly to cutter blade 44 shown in FIG. 7. This tape 66 passes over the lower end of the cutter guard member 40 which is now locked in its extended position holding the tape free of contact with the applicator cutter 44. When the handgrip 50 is in its retracted latched position, the tape carrier 17 is less than fully retracted within the main housing, with the result that its lower end 42 still bears against the inner front end portion of guard member 40 so as to lock the guard member in its normal extended position. Accordingly, tape flows unhampered from its supply role over the lower end of guard member 40 on to the catcher surface of the dispenser cut off blade 65.

The operation of the invention tape applicator and dispenser shown in FIGS. 1–7 will be readily understood from the foregoing detailed description of its structure and principal operating characteristics. The invention is operated as a hand held tape dispenser and applicator by positioning it as shown in FIG. 1 by first pivoting the handgrip 50 from the retracted position of FIG. 5 to the fully extended position of FIG. 1. Latching hooks 52 and 53 cooperate to automatically snap firmly interlocked, and then release the carrier 17 to its fully extended position. When the tape carrier is retracted and the handgrip 50 is extended as best seen in FIG. 2, movement of the tape carrier to the fully extended position is halted by frictional contact of carrier trigger latches 70 and 71 which temporarily hold the tape carrier in a nearly fully retracted position. Light manual pressure applied downwards on the upper side of the lower edge of trigger 33 cooperates with the spring 21 and the resiliency of trigger latch 70 to overcome the frictional hold of said trigger latches and releases the tape carrier to its fully extended position of FIG. 1.

A roll of pressure sensitive tape 19 can be installed by first removing cover 12 by applying lifting pressure to finger grip 16 thereby releasing first one then another of cover latching detents 13. A roll of tape 19 is then telescoped over hub 18 centrally of tape carrier 17 such that the adhesive side of the tape will contact catcher face 36. The free outer tape end 66 is pulled past tape guide 37 and lowered edgewise into the open-sided free space between the lower end of the cutter guard 40 and the catcher face 36. Before attaching the tape 66 to catcher 36 as shown by dotted lines in FIG. 1, the free outer end of the tape is pulled well outwardly of the dispensing port so that a clearly visible and accessible length thereof is exposed beyond the outer end of the tape presser surface 45. Cover 12 is snapped back in place while properly oriented to register its cylindrical posts 68 (FIG. 4) with wells for these posts formed in the underlying portions of the main housing. Operation of the tape applicator 10 as a hand-held dispenser as hereinafter described will provide a clean and untouched free tape end 66 of appropriate predetermined length as shown by dotted lines in FIG. 1. Accordingly, the applicator 10 is now ready for use.

To use the applicator as a hand-held dispenser, the operator holds the applicator by handgrip 50 in one hand and with the other hand grasps the free tape end 66 that extends below catcher face 36. The tape is then pulled outwardly of the dispensing port and forwardly toward the tape presser surface 45, causing the tape to peel off said catcher face 36. After the desired length is dispensed the operator severs the tape by holding said tape firmly and utilizing the index finger of the hand holding the handgrip 50 to apply pressure against the trigger 33 to slide the tape carrier 17 upwardly to its fully retracted position as shown in FIG. 2. As the tape carrier reaches this position, the blade guard member 40 is suddenly unlocked and free to pivot to its retracted position (shown in FIG. 2),whereupon the applicator is pulled rearwards with the aid of the handgrip (or conversely the free end of the tape is pulled forward against cutter guard member 40). This causes the tape to press against and pivot the blade guard 40 and then contact the fixed cutter blade 44 and sever it from the tape supply. The blade is thus initially shielded by the blade guard 40 and then becomes suddenly exposed for rapidly cutting the tape. At about the same time the tape attaches to the face of the tape catcher. After cutting, the blade guard suddenly pushes the tape away from the blade when the carrier is returned to its initial position in FIG. 1. After cutting, a new and untouched free end of the tape adhesively attaches to and rests against the tape catcher surface 36 to which it remains captive with a substantial length of the free end of the tape extending therebeyond. To be observed at this time is the fact that spring 21 functions to automatically return the tape carrier towards its fully extended position. Accordingly, as the operator releases pressure on the trigger 33, the tape carrier extends slightly until trigger latches 70 and 71 are frictionally engaged and temporarily hold the tape carrier in a substantially retracted position. Accordingly, the aforementioned free tape end attached to the tape catcher face 36 is releasably held substantially within the applicator and will not become attached to nearby objects. The tape carrier extends sufficiently before engaging the trigger latches to cause the lower end 42 of carrier front leg **30*b* to engage the upper front surface of cutter guard 40 and quickly lock said cutter guard in the guard position. This pushes the free tape end 66 away from cutter blade 44** and prevents any adhesion of the tape to the cutter blade.

To apply a length of tape to a flat surface 69 the operator releases the tape carrier to the fully extended position of FIG. 1 as heretofore described. The operator holds the applicator in the position shown in FIG. 1 and generally normal to the surface 69 with the free end of the tape 66 there shown in dotted lines projecting slightly beyond the front edge of the applicator housing 11 and underlying the applicator presser pad 45. The operator can see and access this free tape end and can position it directly over the spot desired before depressing it against the surface by the aid of presser pad 45. The operator may place a finger on the exposed nonadhesive side of the tape extending beyond presser pad 45 to maintain the position of the tape and underlying surface 69 during tape application. If the operator wishes to use presser pad 45 to press the free tape end extending beyond it firmly to the surface, the trigger 33 can be retracted a corresponding distance immediately before or after the presser pad is positioned overlying the tape on surface 69. Accordingly, the free tape end 66 attached to the catcher face 36 will be retracted such that the free tape end will lie directly under presser pad 45 and not extend beyond it. Upon retraction of the tape carrier trigger, frictional contact of trigger latches 70 and 71 provides tactile warning that additional retraction of the tape carrier may result in premature severance of the tape. The operator also takes care not to retract the tape carrier beyond this point when positioning and applying the tape. The operator now employs handgrip 50 to pull the applicator rearwards, to the right as shown in FIG. 1, while pressing the tape against the surface with the desired pressure on the tape. Alternatively, if the operator has a finger on the free tape end extending beyond presser pad 45 and holds it firmly to the surface, the applicator can be lifted from the surface and pulled rearwards to dispense additional unapplied tape out of contact with the surface to be taped. This unapplied tape can then be laid onto the surface very accurately in an untensioned condition, thereby avoiding curling or damaging a delicate surface material. As the applicator is moved rearwards, the tape is peeled away from the catcher surface 36 and then feeds past the tape guide surface member 37, past the outer end of guard member 40 and across the presser pad 45 to the surface 69. The application process is repeated and continued until the desired continuous length of tape has been applied.

After the desired length of tape has been applied in this manner, the operator utilizes the index finger against trigger 33 to shift tape carrier 17 inwardly to its fully retracted position past tape trigger latch 70, as best seen in FIG. 3. This causes tape to be severed in the aforementioned mentioned manner. Tape application and severing can be done in a continuous movement without stopping. Where high accuracy is required, the operator ceases the rearward movement of the tape applicator, holding it positioned at the desired cut off point while depressing the trigger 33. Continued rearward movement of the applicator severs the tape in the aforementioned manner. After severing the tape, the trigger 33 is released and tape carrier 17, biased toward the extended position by spring 21, extends a slight distance downwards until trigger latches 70 and 71 are frictionally engaged to releasably hold the tape carrier in a substantially retracted position with a sufficient length of the tape end extending from catcher face 36 for accurate and visible registry with a surface to be taped in the next operating cycle of the applicator. Accordingly, the free tape end is held releasably retracted substantially within the interior of the applicator and will not become reattached to the surface just taped or to another nearby object until the carrier is released at the start of the next application cycle.

As soon as the operator has finished using the applicator, he depresses handgrip latching member 53 and folds the handgrip clockwise about its pivot 51. As this operation takes place, nose 34 of trigger 33 engages the camming surface 57 of handgrip web 56 and cams the carrier toward its nearly fully retracted position. As the handgrip reaches its fully collapsed position, handgrip latch 53 bears against surface of trigger 33 closely adjacent nose 34 of the trigger in the position shown in FIG. 5 wherein it is effective to latch the handgrip retracted. The free end of the tape is now retracted and held captive on catcher face 36 in a fully concealed and protective condition. The edges of handgrip webs 58 prevent the free end of the tape adhering to the interior of the handgrip.

If the applicator is to be used as a desk-mounted tape dispenser, the operator first unlatches the handgrip sufficiently to grasp the free end of the tape and pull a sufficient portion thereof outwardly beyond presser pad 45 to extend through a dispensing port formed by a small gap between the outer end sidewall of the handgrip and presser pad 45, as best seen in FIG. 6. This having been done, handgrip 50 is latched in its retracted position and then inserted into the well of dispenser base 60, with the free end of tape 66 held captive against the surface of the cutoff blade and tape catcher 65. The operator may now dispense the tape manually by grasping the same rearwardly of pedestal 64 and pulling a desired portion thereof outwardly from the main housing. A desired length having been dispensed, it is cut off by the aid of cutter 65 as is customary in the use of well known desk-mounted tape dispensers.

While the particular combination tape applicator and tape dispenser herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A dispenser for a roll of pressure sensitive adhesive tape comprising:

a housing having a tape dispensing port adjacent one end wall thereof;

tape carrier means for a roll of tape reciprocally supported within said housing for movement between extended and retracted positions and normally biased to said extended position adjacent said port;

said carrier means having a tape catcher crosswise of and cooperating with said housing in forming a part of said tape dispensing port, said catcher having a surface facing the adhesive side of the leading end of a roll of pressure sensitive tape adapted to be rotatably mounted on said carrier means and said catcher being operable to hold said tape captive rearwardly of the leading end thereof between tape dispensing cycles;

a tape cutter extending crosswise of said dispensing port with the cutting edge thereof facing toward the uncoated side of said tape; and cutter guard means normally positioned closely adjacent said tape cutter and positioned to prevent said tape from contacting said cutter means so long as said carrier is in an extended position and movable to permit said tape to be severed by said tape cutter when said carrier is in the retracted position thereof.

2. A tape dispenser as defined in claim 1 characteized in that said cutter means is fixedly supported crosswise of said dispensing port.

3. A tape dispenser as defined in claim 1 characterized in that said cutter is fixedly mounted in said housing crosswise of said dispensing port with the cutting edge inclined to the normal plane of said tape in the area thereof undergoing severing.

4. A tape dispenser as defined in claim 1 characterized in that said housing and said carrier means include mutually cooperating means effective to hold said guard means in position to prevent said tape from contacting said cutter means so long as said carrier means is in the extended position thereof.

5. A tape dispenser as defined in claim 1 including means for bringing the adhesive side of said tape into contact with said tape catcher during the movement of said carrier means between the extended and retracted positions thereof.

6. A tape dispenser as defined in claim 1 characterized in that all portions of said tape out of contact with the supply roll thereof remain unclamped at all times including the severance of a dispensed length therof said cutter means.

7. A tape dispenser as defined in claim 1 including tape presser means crosswise of the exterior side of said tape dispensing port, and a cutter rigidly supported in said tape presser means, said cutter having an exposed serrated cutting edge extending transversely of said tape and lying at an acute angle to the adjacent normal position of said tape.

8. A tape dispenser as defined in claim 7 characterized in that said cutter means is operable to sever the dispensed end of said tape in a transverse line spaced very substantially outwardly from said tape catcher while said carrier is held in the retracted position thereof.

9. A tape dispenser as defined in claim 8 characterized in that said tape catcher is normally positioned closely adjacent to said cutter means and to said tape dispensing port whereby the free end of said tape outwardly of said catcher means can be grasped and viewed as it is pressed against a surface at the beginning of a taping cycle.

10. A tape dispenser as defined in claim 1 characterized in that said housing is provided with a handgrip projecting outwardly from one edge of said housing; and said tape carrier means having a portion thereof projecting outwardly from said housing and positioned to be actuated by the operator between the extended and retracted positions of said carrier while the operator is grasping said handgrip.

11. A tape dispenser as defined in claim 10 characterized in that said handgrip is pivoted to said housing; and means for releasably anchoring said handgrip firmly in an extended hand grasping position thereof.

12. A tape dispenser as defined in claim 10 characterized in that said handgrip is foldable to a retracted position with a portion therof cooperating with said housing to form a tape dispensing port.

13. A tape dispenser as defined in claim 10 characterized in that said handgrip is movably connected to said housing with means for anchoring the same firmly and selectively in an extended position and in a retracted position closely against one lateral edge of said housing.

14. A tape dispenser as defined in claim 13 characterized in that said handgrip and an adjacent portion of said tape carrier include mutually cooperating means for shifting said carrier to a retracted position thereof as said handgrip is moved from said extended position to the retracted position thereof.

15. A dispenser for coiled pressure sensitive tape comprising:

a housing having a tape dispensing port and reciprocally supporting therein a tape carrier biased to an extended position thereof and manually shiftable to a retracted position thereof for storage and temporarily while a dispensed length of tape is being severed;

a tape cutter supported crosswise of one edge of said dispensing port;

said tape carrier having a tape catcher normally positioned crosswise of said dispensing port and adjacent said cutter and adapted to be in captive engagement with the tape adhesive between tape dispensing cycles;

manually operable means for retracting said carrier while said dispenser is hand held and in use dispensing tape;

means for retaining said carrier in a generally retracted position thereof with the free end of said tape held captive on said tape catcher and substantially withdrawn within said housing.

16. A tape dispenser as defined in claim 15 characterized in that said housing is provided with a handgrip movably connected thereto for movement between a substantially retracted position beside said housing and a stable extended position in which said dispenser can be hand held and manipulated to dispense and apply tape to an object.

17. A tape dispenser as defined in claim 15 characterized in that said means for retracting said carrier includes said handgrip, and camming means actuated by the retraction movement of said handgrip to engage said carrier to shift the latter toward the retracted position thereof.

18. A tape dispenser as defined in claim 17 characterized in the provision of means for releasably holding said handgrip selectively in each of said retracted and extended positions.

19. A tape dispenser as defined in claim 15 characterized in the provision of cutter guard means mounted in said housing and normally positioned to prevent contact of said tape with said cutter so long as said tape carrier is not in the retracted position thereof.

20. A tape dispenser as defined in claim 19 characterized in that said cutter guard means is movable to a position permitting the tape to contact and be severed by said cutter means when said carrier is substantially fully retracted.

21. A tape dispenser as defined in claim 15 characterized in the provision of a weighted base having an upwardly facing seat for receiving and retaining said dispenser housing stationary and releasably captive, tape catcher means projecting upwardly from said base and spaced forwardly from said tape dispensing port by a distance readily accommodating the insertion of the user's finger to lift the tape end from said tape catcher means.

22. A tape dispenser as defined in claim 15 characterized in that said dispenser, excluding said tape cutter, is formed from molded nonmetallic components shaped and configured for assembly to one another without fasteners and/or adhesive.

23. A tape dispenser as defined in claim 15 characterized in that said dispenser, excluding said tape cutter, is formed from molded components shaped and configured for assembly and disassembly without need for fasteners.

24. A dispenser for coiled tape coated with pressure sensitive adhesive comprising:

a cupped housing of generally egg shape having a tape dispensing port at a smaller end thereof;

a tape roll carrier reciprocally supported within said housing for movement toward and away from said port and normally spring biased to an extended position adjacent said port and provided with a tape catcher normally captively adherent to a leading end portion of said tape while said dispenser is not in use;

tape cutter means crosswise of said port on the opposite side of said tape from said tape catcher including cutter guard means for preventing said tape from being severed while tape is being withdrawn from said dispensing port; and manually operable means for retracting said carrier toward a retracted position thereof and for releasing said cutter guard means to permit severance of said tape by said cutter means.

25. A tape dispenser as defined in claim 24 characterized in that said cutter means is contoured to initiate tape severing by nicking one lateral edge of said tape.

26. A tape dispenser as defined in claim 24 characterized in that said carrier is operable to maintain said cutter guard means in an extended cutter guarding position until said carrier approaches a retracted position thereof whereupon said guard means is movable to a non-guarding retracted position leaving said cutter exposed for severing said tape.

27. A tape dispenser as defined in claim 26 characterized in that said guard means includes means cooperating with said carrier to maintain said guard means in guard position so long as said carrier is in an extended position thereof.

28. A tape dispenser as defined in claim 24 characterized in that said housing includes a handgrip on the exterior thereof.

29. A tape dispenser as defined in claim 24 including means for pressing the adhesive side of said tape against said tape catcher automatically as said carrier is en route between the retracted and extended positions thereof.

30. A tape dispenser as defined in claim 29 characterized in that said tape is free of pressure applied to hold the same captive on said catcher when the carrier is in its extended position.

31. A tape dispenser as defined in claim 24 characterized in that a narrow transverse exterior portion of said housing at said tape dispensing port provides means operable to hold a contiguous length of said tape pressed against an underlying surface while being applied thereagainst.

32. A tape dispenser as defined in claim 24 characterized in that said housing includes means fo attaching the adhesive side of said tape to said catcher while said carrier is moving between the extended and retracted positions thereof.

33. A tape dispenser as defined in claim 32 characterized in that means for attaching said tape to said catcher is operable to engage said tape with said catcher in an area of said tape spaced backwardly from the outer end thereof sufficiently to leave a substantial length of tape protruding from said dispensing port at the conclusion of a tape dispensing cycle.

34. A tape dispenser as defined in claim 24 characterized in that said dispenser includes manual means operable to move said carrier to a retracted position thereof and to retain the same releasably in said retracted position.

35. A tape dispenser as defined in claim 34 characterized in the provision of weighted base means for receiving and supporting said dispenser housing captively in an upright position with said dispensing port positioned rearwardly of an upwardly protruding tape catcher and severing means on said base means.

36. A tape dispenser as defined in claim 35 characterized in that said tape catcher on said carrier is ineffective to hold said tape captive after being manually released therefrom while said carrier is retained in a retracted position.

* * * * *